US010042378B2

(12) United States Patent
Mladenova

(10) Patent No.: US 10,042,378 B2
(45) Date of Patent: Aug. 7, 2018

(54) ON CHIP TEMPERATURE INDEPENDENT CURRENT GENERATOR

(71) Applicant: ROHM CO., LTD., Ukyo-ku, Kyoto (JP)

(72) Inventor: Irina Mladenova, Kyoto (JP)

(73) Assignee: ROHM CO., LTD., Kyoto (JP)

( * ) Notice: Subject to any disclaimer, the term of this patent is extended or adjusted under 35 U.S.C. 154(b) by 0 days.

(21) Appl. No.: 15/592,596

(22) Filed: May 11, 2017

(65) Prior Publication Data

US 2017/0329362 A1 Nov. 16, 2017

(30) Foreign Application Priority Data

May 13, 2016 (EP) ..... 16169716

(51) Int. Cl.
*G05F 3/00* (2006.01)
*G05F 3/26* (2006.01)

(52) U.S. Cl.
CPC ..... *G05F 3/267* (2013.01)

(58) Field of Classification Search
None
See application file for complete search history.

(56) References Cited

U.S. PATENT DOCUMENTS 7,915,882 B2 * 3/2011 Hellums ..... G05F 1/468 323/312

* cited by examiner

*Primary Examiner* — Adolf Berhane
*Assistant Examiner* — Henry Lee, III
(74) *Attorney, Agent, or Firm* — Cantor Colburn LLP

(57) ABSTRACT

An on chip temperature independent current generator for generating a temperature independent current, said temperature independent current generator including: an on chip current generator having an output to provide an electrical current being proportional to an absolute temperature of a chip in which the temperature independent current generator is embedded; and an on chip transistor having a base connected to a temperature independent reference voltage generator, a collector connected to a current mirror, and an emitter connected to the output of the on chip current generator and connected via an on chip resistor to a reference potential, wherein the current mirror is adapted to mirror a collector current flowing to the collector of said on chip transistor to generate the temperature independent current.

8 Claims, 3 Drawing Sheets

ON CHIP TEMPERATURE INDEPENDENT CURRENT GENERATOR

CROSS-REFERENCE TO RELATED APPLICATION

The present invention claims priority under 35 U.S.C. § 119 to European Patent Application No. 16169716.4, filed May 13, 2016, the entire contents of which are incorporated herein by reference.

TECHNICAL FIELD

The present disclosure relates to an on chip temperature independent current generator for generating a temperature independent current which can be supplied to other circuit elements of an integrated circuit.

BACKGROUND

Conventional current generators which can generate a temperature independent current can be based on voltage to current converter circuits and require a temperature independent reference voltage band gap as well as a temperature independent resistance. However, it is difficult to implement this kind of current generator in CMOS technology.

Further, there are known conventional temperature independent current generators including current DACs and a set of current mirrors in which a first current proportional to the absolute temperature and a second current complementary to the absolute temperature are mixed in proper proportion to provide a temperature independent current. However, providing a temperature independent current this way requires a precise trimming of the temperature dependency compensation.

SUMMARY

The present disclosure provides some embodiments of an on chip temperature independent current generator which does not require a trimming.

The on chip temperature independent current generator of the present disclosure includes the features of claim 1.

The present disclosure provides an on chip temperature independent current generator for generating a temperature independent current, wherein said on chip temperature independent current generator includes: an on chip current generator having an output to provide an electrical current being proportional to an absolute temperature of a chip in which the temperature independent current generator is embedded; and an on chip transistor having a base connected to a temperature independent reference voltage generator, a collector connected to a current mirror, and an emitter connected to the output of the on chip current generator and connected via an on chip resistor to a reference potential, wherein the current mirror is adapted to mirror a collector current flowing to the collector of said on chip transistor to generate the temperature independent current.

In a possible embodiment of the on chip temperature independent current generator according to the present disclosure, the on chip transistor includes an on chip bipolar NPN transistor.

In a further possible embodiment of the on chip temperature independent current generator according to the present disclosure, the current mirror includes a CMOS or BJT current mirror.

In a further possible embodiment of the on chip temperature independent current generator according to the present disclosure, the on chip current generator includes an operation amplifier having an inverting input to which a first bipolar transistor is connected, a non-inverting input to which a second bipolar transistor is connected via a resistor having a predetermined resistance, and an output connected to an integrated CMOS current mirror of said on chip current generator.

In a further possible embodiment of the on chip temperature independent current generator according to the present disclosure, the on chip resistor is of the same type as the resistor of the on chip current generator.

In a further possible embodiment of the on chip temperature independent current generator according to the present disclosure, the on chip resistor has a resistance being m times the resistance of the resistor of said on chip current generator, wherein m is a positive real number.

In a still further possible embodiment of the on chip temperature independent current generator according to a first aspect of the present disclosure, the resistance of the resistor of said on chip current generator is dependent on the temperature of said chip.

In a still further possible embodiment of the on chip temperature independent current generator according to the present disclosure, the resistance of the resistor of said on chip current generator is temperature independent.

In a further possible embodiment of the on chip temperature independent current generator according to the present disclosure, the current generated by said temperature independent current generator is temperature independent in a wide temperature range between about −60° Celsius and about +200° Celsius.

In a further possible embodiment of the on chip temperature independent current generator according to the present disclosure, the current generated by the temperature independent current generator includes a nominal current amplitude in a range of about 0.6 to 1.0 μAmp.

BRIEF DESCRIPTION OF THE DRAWINGS

In the following, possible embodiments of the on chip temperature independent current generator according to the present disclosure are described in more detail with reference to the enclosed figures.

DETAILED DESCRIPTION

Figure 1:
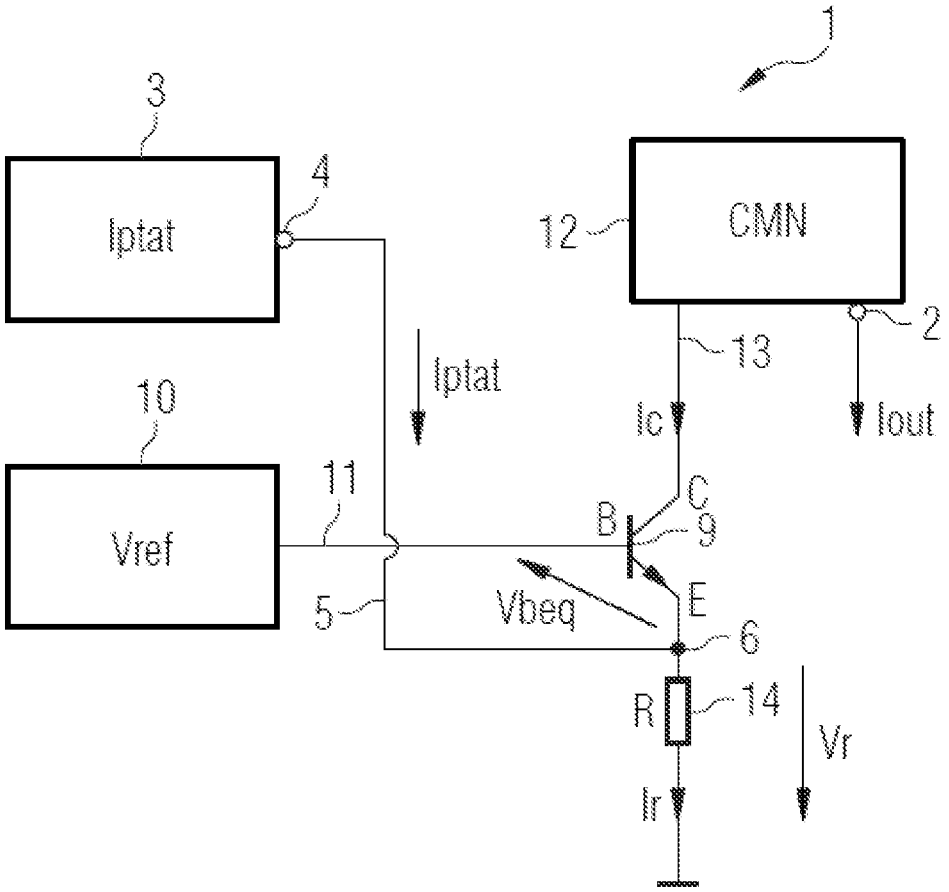
FIG. 1 shows a circuit diagram for illustrating a possible exemplary embodiment of an on chip temperature independent current generator according to the present disclosure.

As can be seen in FIG. 1, an on chip temperature independent current generator 1 is configured to generate a temperature independent current output by the on chip temperature independent current generator 1 at an output terminal 2 as illustrated in FIG. 1. The on chip temperature independent current generator 1 includes in the illustrated embodiment an on chip current generator 3 having an output 4 to provide an electrical current $I_{PTAT}$ having a current amplitude being proportional to an absolute temperature T of a chip in which the on chip temperature independent current generator 1 is embedded. The output 4 of the on chip current generator 3 is connected via a line 5 to an internal node 6 connected to the emitter E of an on chip transistor 9 which is formed in the illustrated embodiment by an on chip bipolar NPN transistor. The on chip transistor 9 has a base B connected to a temperature independent reference voltage generator 10 via an internal line 11. The temperature independent reference voltage generator 10 can be in a possible embodiment formed by a band gap voltage generator. The on chip transistor 9 further includes a collector C connected to a current mirror 12 via a line 13. The on chip transistor 9 includes an emitter E connected to the internal node 6 and connected via the line 5 to the output 4 of the on chip current generator 3. The emitter E of the on chip transistor 9 is further connected via an on chip resistor 14 to a reference potential GND (Ground). The current mirror 12 is adapted to mirror the collector current $I_C$ flowing through the collector C of the on chip transistor 9 to generate the temperature independent current $I_{out}$ at the output terminal 2 of the on chip temperature independent current generator 1. The current mirror 12 is in a preferred embodiment a CMOS current mirror or a BJT current mirror. The on chip independent reference voltage generator 10 can be in a possible embodiment formed by an on chip reference voltage generator integrated on the chip. In an alternative embodiment, the reference voltage generator 10 can also be formed by an external voltage reference source. The current mirror 12 can be adapted to mirror, multiply and/or replicate the collector current $I_C$ of the on chip bipolar NPN transistor 9.

Figure 2:
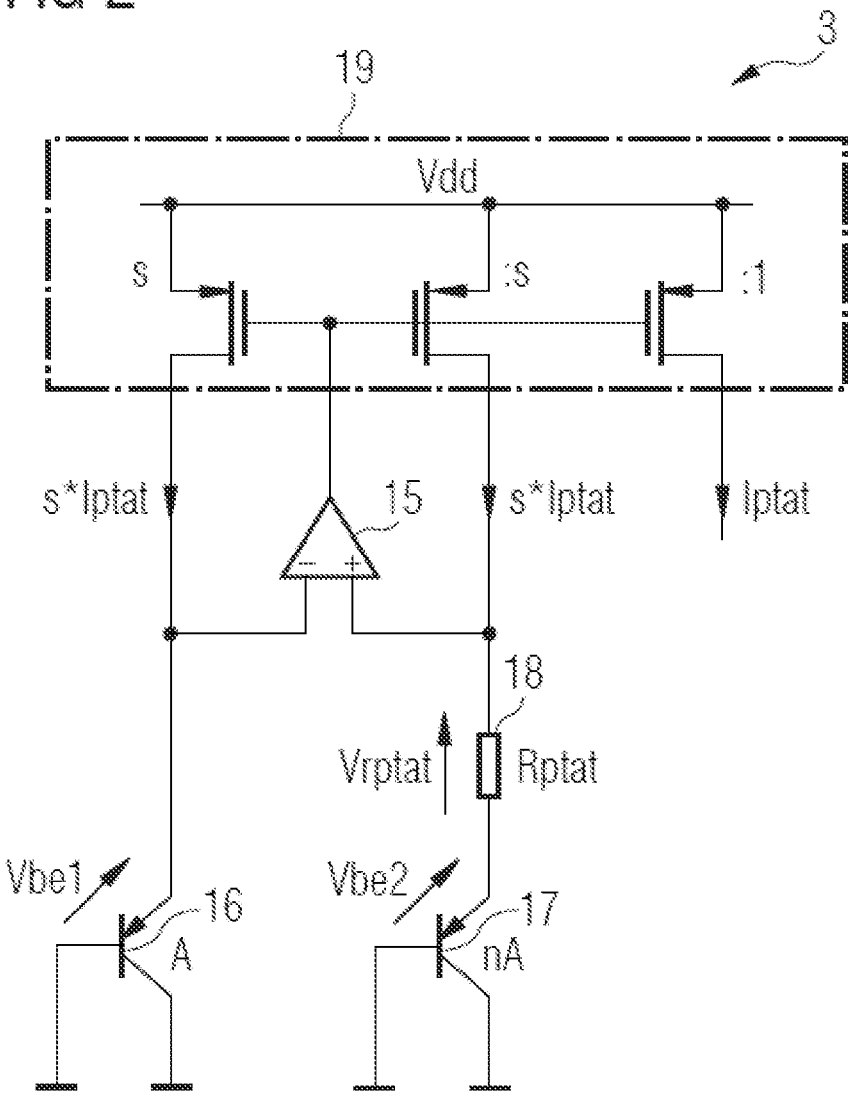
FIG. 2 shows a circuit diagram of a possible exemplary implementation of an on chip current generator integrated in the on chip temperature independent current generator according to the present disclosure as illustrated in the embodiment of FIG. 1.

The on chip current generator 3 can be implemented in a possible exemplary embodiment by a circuit as illustrated in FIG. 2. In the illustrated embodiment, the on chip current generator 3 includes an operation amplifier 15 having an inverting input (−) and a non-inverting input (+). In a possible embodiment, the inverting input (−) of the operation amplifier 15 is connected to a first bipolar transistor 16 and the non-inverting input (+) of the operation amplifier 15 is connected to a second bipolar transistor 17 via a resistor 18 as illustrated in FIG. 2. The resistor 18 includes a predetermined resistance $R_{PTAT}$. The operation amplifier 15 includes an output connected to an integrated CMOS current mirror 19 of the on chip current generator 3. The on chip resistor 14 as illustrated in FIG. 1 is in a preferred embodiment of the same type and/or material as the resistor 18 of the on chip current generator 3. The on chip resistor 14 includes in a possible embodiment a resistance $m*R_{PTAT}$ being m times the resistance $R_{PTAT}$ of the resistor 18 of the on chip current generator 3 wherein m is an integer number equal or greater than 1. The resistance $R_{PTAT}$ of the resistor 18 of the on chip current generator 3 as illustrated in FIG. 2 is in a possible embodiment dependent on the temperature T of the chip. In an alternative embodiment, the resistance $R_{PTAT}$ of the resistor 18 of the on chip current generator 3 is temperature independent.

The current $I_{out}$ generated by the temperature independent current generator 1 is in a possible embodiment temperature independent in a wide temperature range between, e.g., about −60° Celsius and about +200° Celsius. The generated temperature independent current $I_{out}$ at the output terminal 2 of the on chip temperature independent current generator 1 can include in a possible embodiment a nominal current amplitude in a range of about 0.6 to 1.0 μAmp.

As can be seen in the circuit diagram of FIG. 2, the base emitter voltage $V_{be1}$ of the bipolar transistor 16 is equal to the base emitter voltage $V_{be2}$ of the second bipolar transistor 17 reduced by the voltage drop across the resistor 18:

$$V_{be1}=V_{be2}+V_{rptat} \tag{1}$$

The current mirror 19 supplies the resistor 18 with a current $s*I_{PTAT}$ as shown in FIG. 2 so that the voltage drop across the resistor 18 is given by:

$$V_{rptat}=s*I_{PTAT}*R_{PTAT} \tag{2}$$

The base emitter voltage $V_{be}$ across the bipolar transistors 16, 17 is given as follows:

$$V_{be1}=\varphi_T*\ln(s*I_{PTAT}/I_s) \tag{3}$$

$$V_{be2}=\varphi_T*\ln(s*I_{PTAT}/(I_s*n)), \tag{4}$$

wherein n is a ratio or a multiplication factor.

Further, $$\varphi_T=\frac{K*T}{e}, \tag{5}$$

wherein K is a Boltzmann constant, T is the temperature in Kelvin, and e is the charge of an electron.

$I_s$ is the temperature current of a pn-junction of a bipolar transistor, and s is the number of the current mirror sections in the PTAT current generator.

Consequently:

$$V_{rptat}=V_{be1}-V_{be2} \tag{6}$$

$$s*I_{PTAT}*R_{PTAT}=\varphi_T(1n(s*I_{PTAT}/I_s)-1n(s*I_{PTAT}/(I_s*n))) \tag{7}$$

$$s*I_{PTAT}*R_{PTAT}=\varphi_T*1n\left(\frac{1}{n}\right) \tag{8}$$

$$I_{PTAT}=\varphi_T*1n(n)/(s*R_{PTAT})=\frac{KT}{e}en(n)/(sR_{PTAT}) \tag{9}$$

Expression (9) is a formula for calculating the generated current $I_{PTAT}$ output by the on chip current generator 3 at the output 4 via the line 5 to the internal node 6 of the on chip temperature independent current generator 1. The generated electrical current $I_{PTAT}$ depends on design parameters n, s, $R_{PTAT}$ and a physical parameter, i.e., the temperature T in Kelvin.

The resistor 14 is of the same type and/or material as the resistor 18 used for the PTAT current generator 3:

$$R=m*R_{PTAT} \tag{10}$$

wherein R is the resistance of resistor 14 and $R_{PTAT}$ is the resistance of resistor 18 and m can be any positive real number.

The output current $I_{out}$ can be a replica or multiplied product of the current $I_{PTAT}$:

$$I_{OUT}=l*I_{PTAT} \tag{11}$$

wherein l is an integer number.

The output current $I_{out}$ has the same temperature dependency as the collector current $I_C$. Accordingly, it is sufficient to make the collector current $I_C$ temperature independent.

Based on the first Kirchhoff law and ignoring the base current $I_B$ of the NPN transistor 9 gives:

$$I_C+I_{PTAT}=I_R \tag{12}$$

-continued or $$I_C = I_R - I_{PTAT} \tag{13}$$

with:

$$I_R = \frac{V_R}{R} - \frac{V_R}{m * R_{PTAT}} \tag{14}$$

and $$V_R = V_{REF} - V_{BEQ} \tag{15}$$

The collector current $I_C$ can be expressed as follows:

$$I_C = \frac{V_{REF} \quad V_{BEQ}}{m * R_{PTAT}} - I_{PTAT} \tag{16}$$

$V_{BEQ}$ is the voltage between the base B and the emitter E terminals of the bipolar transistor 9. This voltage can have a negative temperature dependency ΔVbeq around 2 mV/Kelvin. Because of the small temperature dependency, it is possible to write:

$$V_{BEQ}=V_{BEQ0}-T*\Delta V_{BEQ}, \tag{17}$$

wherein $V_{BEQ0}$ is the emitter-base voltage of the transistor 9 at 0° K.

Using the equation (9) one can re-write equation (16) in the following way:

$$I_C = \frac{V_{REF} - V_{BEQ0}}{m * R_{PTAT}} + \frac{T * \Delta V_{BEQ}}{m * R_{PTAT}} - \frac{K * T}{e} * 1n(n)/(s * R_{PTAT}) \tag{18}$$

The resistance of the resistor 18 can be either temperature independent or temperature dependent.

To provide a temperature independent current by the on chip temperature independent current generator 1, it is necessary that the collector current $I_C$ is temperature independent. By differentiating both sides of equation (18) with the temperature T and by assuming that the reference voltage $V_{REF}$ provided by the temperature independent reference voltage generator 10 and the voltage $V_{BEQ0}$ are constant, one arrives to the following equation:

$$0 = \frac{\Delta V_{BEQ}}{m * R_{PTAT}} - \frac{K}{e} * 1n(n)/(s * R_{PTAT}) \tag{19}$$

Equation (19) can be rewritten as:

$$\frac{\Delta V_{BEQ}}{m} = \frac{K}{e * s} * 1n(n) \tag{20}$$

Equation (20) can be rewritten as follows:

$$\frac{s}{m * 1n(n)} = \frac{K}{e * \Delta V_{BEQ}} \tag{21}$$

Accordingly, by knowing the voltage ΔVbeq from a technology specification and by fixing two of the three free selectable design parameters m, n, and s, it is possible to determine the third design parameter from equation (21) such that the collector current $I_C$ is temperature independent.

In a second alternative embodiment, the resistance $R_{PTAT}$ of the resistor 18 is temperature dependent. In this case, the resistance of the resistor can have a first order temperature coefficient $T_C$. Further, other temperature coefficients can be ignored because of their small influence.

The resistance $R_{PTAT}$ of the resistor 18 can be written as follows:

$$R_{PTAT}=R_{PTAT0}*(1+T_C*T) \tag{22}$$

wherein $R_{PTAT0}$ is the resistor value at 0° K.

Rewriting equation (18) leads to the following equation:

$$I_C = \frac{V_{REF} - V_{BEQ0}}{m * R_{PTAT0} * (1 + T_C * T)} + \frac{T * \Delta V_{BEQ}}{m * R_{PTAT0} * (1 + T_C * T)} - \frac{K * T}{e * s * R_{PTAT0} * (1 + T_C * T)} * 1n(n) \tag{23}$$

which can be rewritten into:

$$I_C = \frac{V_{REF} - V_{BEQ0}}{m * R_{PTAT0} * (1 + T_C * T)} + \frac{T * \Delta V_{BEQ}}{m * R_{PTAT0} * (1 + T_C * T)} - \frac{K * T * m}{e * s * m * R_{PTAT0} * (1 + T_C * T)} * 1n(n) \tag{24}$$

Since $m*R_{PTAT0}$ is constant, both sides of equation (24) can be multiplied with this value:

$$I_C * m * R_{PTAT0} = \frac{V_{REF} - V_{BEQ0}}{(1 + T_C * T)} + \frac{T * \Delta V_{BEQ}}{(1 + T_C * T)} - \frac{K * T * m}{e * s * (1 + T_C * T)} * 1n(n) \tag{25}$$

Differentiating equation (25) on both sides with the temperature T gives:

$$0 = \frac{V_{REF} - V_{BEQ0} * T_C}{(1 + T_C * T)^2} + \frac{\Delta V_{BEQ}}{(1 + T_C * T)^2} - \frac{K * m * 1n(n)}{e * s * (1 + T_C * T)^2} \tag{25}$$

and $$0 = \frac{e * s * \Delta V_{BEQ} - T_C * (V_{REF} - V_{BEQ0})) - K * m * 1n(n)}{e * s * (1 + T_C * T)^2} \tag{26}$$

or $$e * s * (\Delta V_{BEQ} - T_C(V_{REF} - V_{BEQ0})) - K * m * 1n(n) = 0 \tag{27}$$

$$e * s * (\Delta V_{BEQ} - T_C(V_{REF} - V_{BEQ0})) = K * m * 1n(n) \tag{28}$$

From this follows:

$$\frac{s}{m * 1n(n)} = \frac{K}{e * (\Delta V_{BEQ} - T_C(V_{REF} - V_{BEQ0}))} \tag{29}$$

Consequently, by knowing ΔVbeq, $V_{BEQ0}$ and the temperature coefficient $T_C$ from the technology specification, it is possible by fixing two of the three free selectable design parameters m, n, and s to determine the third design parameter from equation (29) such that the collector current $I_C$ becomes temperature independent.

Figure 3:
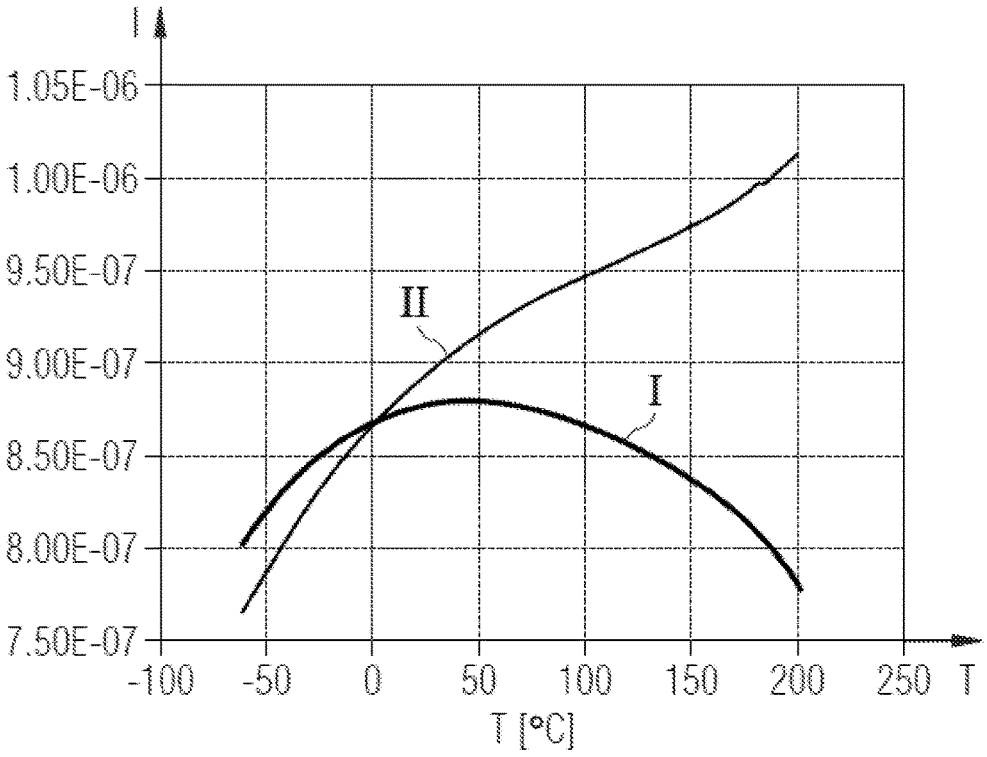
FIG. 3 shows a diagram for illustrating the operation of an on chip temperature independent current generator according to the present disclosure in comparison to a conventional current generator.

FIG. 3 is a diagram illustrating the temperature dependency of an electrical current generated by a conventional current generator and by an embodiment of an on chip temperature independent current generator 1 according to the present disclosure. The curve I illustrates the current $I_{out}$ generated by the on chip temperature independent current generator 1 in a wide temperature range between about −60° Celsius and about +200° Celsius. Curve II illustrates an electrical current provided by a conventional current generator. As can be seen from the curves illustrated in FIG. 3, the current $I_{out}$ generated by the temperature independent current generator 1 according to the present disclosure (curve I) is almost completely temperature independent in the wide temperature range between −60° Celsius and +200° Celsius. In contrast, the conventional current generator (curve II) generates a temperature dependent current. With increasing temperature, the current generated by the conventional current generator increases steadily. FIG. 3 shows a simulation plot of the generated currents depending on temperature T of the chip. As can be seen from FIG. 3, the current $I_{out}$ generated by the temperature independent current generator 1 includes a nominal current amplitude of about 0.8 μAmp, i.e., in a range of about 0.6 to 1.0 μAmp.

While certain embodiments have been described, these embodiments have been presented by way of example only, and are not intended to limit the scope of the disclosures. Indeed, the novel methods and apparatuses described herein may be embodied in a variety of other forms; furthermore, various omissions, substitutions and changes in the form of the embodiments described herein may be made without departing from the spirit of the disclosures. The accompanying claims and their equivalents are intended to cover such forms or modifications as would fall within the scope and spirit of the disclosures.

What is claimed is:

1. An on chip temperature independent current generator for generating a temperature independent current, said temperature independent current generator comprising:

an on chip current generator having an output to provide an electrical current being proportional to an absolute temperature of a chip in which the temperature independent current generator is embedded; and an on chip transistor having a base connected to a temperature independent reference voltage generator, a collector connected to a current mirror, and an emitter connected to the output of the on chip current generator and connected via an on chip resistor to a reference potential, wherein the current mirror is adapted to mirror a collector current flowing to the collector of said on chip transistor to generate the temperature independent current, and wherein said on chip current generator comprises an operation amplifier having an inverting input to which a first bipolar transistor is connected, a non-inverting input to which a second bipolar transistor is connected via a resistor having a predetermined resistance, and an output connected to an integrated CMOS current mirror of said on chip current generator.

2. The on chip temperature independent current generator according to claim 1, wherein said on chip transistor is an on chip bipolar NPN transistor.

3. The on chip temperature independent current generator according to claim 1, wherein said current mirror is a CMOS or BJT current mirror.

4. The on chip temperature independent current generator according to claim 1, wherein said on chip resistor is of the same type as the resistor of said on chip current generator.

5. The on chip temperature independent current generator according to claim 4, wherein said on chip resistor has a resistance being m times the resistance of the resistor of said on chip current generator, wherein m is a positive real number.

6. The on chip temperature independent current generator according to claim 1, wherein the resistance of the resistor of said on chip current generator is dependent on the temperature of said chip.

7. The on chip temperature independent current generator according to claim 1, wherein the resistance of the resistor of said on chip current generator is temperature independent.

8. The on chip temperature independent current generator according to claim 1, wherein the current generated by said temperature independent current generator is temperature independent in a wide temperature range between about −60° Celsius and about +200° Celsius.

* * * * *